US006758351B1

(12) United States Patent
Klingsdal

(10) Patent No.: US 6,758,351 B1
(45) Date of Patent: Jul. 6, 2004

(54) DEVICE IN CONNECTION WITH HANGING LAUNDRY

(76) Inventor: Britt Klingsdal, Kajutavagen 7, 136 71 Haninge (SE)

( * ) Notice: Subject to any disclaimer, the term of this patent is extended or adjusted under 35 U.S.C. 154(b) by 0 days.

(21) Appl. No.: 10/111,118

(22) PCT Filed: Apr. 27, 2000

(86) PCT No.: PCT/SE00/00795

§ 371 (c)(1),
(2), (4) Date: Apr. 19, 2002

(87) PCT Pub. No.: WO01/31107

PCT Pub. Date: May 3, 2001

(30) Foreign Application Priority Data

Oct. 25, 1999 (SE) ..... 9901499

(51) Int. Cl.[7] ..... A47F 5/00
(52) U.S. Cl. ..... 211/119.18; 211/123
(58) Field of Search ..... 211/119.1, 119.01, 211/119.18, 105.1, 123, 87.07, 89.01, 13.1, 85.2, 85.3, 105.2, 6, 105.6, 86.01, 119.009, 183

(56) References Cited

U.S. PATENT DOCUMENTS 1,969,958 A * 8/1934 Alden
2,058,416 A * 10/1936 Comstock ..... 211/123
2,469,774 A * 5/1949 Kosimski ..... 211/119.18
2,605,030 A * 7/1952 Fischer
2,650,716 A * 9/1953 Klein ..... 211/119.18
3,383,244 A * 5/1968 Falek ..... 211/123
4,372,449 A * 2/1983 Fink ..... 211/106 X
4,702,381 A * 10/1987 Carter et al. ..... 211/105.2
4,729,482 A * 3/1988 Nicholson ..... 211/105.2
D305,402 S * 1/1990 Novak
4,971,210 A * 11/1990 Blumenkranz et al. ..... 211/123

FOREIGN PATENT DOCUMENTS

| | | |
|---|---|---|
| DE | 582803 | 11/1933 |
| DE | 3004040 | 8/1981 |
| DE | 4034318 | 4/1992 |

* cited by examiner

*Primary Examiner*—Robert W. Gibson, Jr.
(74) *Attorney, Agent, or Firm*—Rolf Fasth; Fasth Law Offices

(57) ABSTRACT

The present invention relates to a device in connection with hanging laundry, said device having means for cooperating with at least one wash-line, and that said cooperation being that the wash-line supports the device according to the invention. In connection with hanging laundry there will normally be a fold in the garments that have been hung over a wash-line. It is significant for the device according to the invention that it has a length that is essentially larger than its width, and that the device has sub surfaces that define an imaginary, curved surface that is convex on the side facing away from the device.

4 Claims, 3 Drawing Sheets

DEVICE IN CONNECTION WITH HANGING LAUNDRY

PRIOR APPLICATIONS

This application is a U.S. national phase application based upon International Application No. PCT/SE00/007950 filed 27 Apr. 2000; which claims priority from Swedish Application No. 9901499-5, filed 25 Oct. 1999.

TECHNICAL FIELD OF THE INVENTION

The present invention relates to a device in connection with hanging laundry, said device having means for cooperating with at least one wash-line, and that said cooperation being that the wash-line supports the device according to the invention.

PRIOR ART

From JP 2198598 a yoke shaped device is previously known, a number of such devices being intended to be mounted on wash-lines extending parallel to each other, said wash-lines passing through openings in the devices. No convex, continuous surface for supporting laundry is created by means of said devices. In practice the devices are permanently mounted on the wash-lines since the latter passes through holes of the yoke shaped devices.

From FI-B80081 devices in the shape of so-called intermediate holders are previously known, said holders keeping adjacent wash-lines separated in a system of wash lines in a drying room. A number of intermediate holders are mounted on each pair of adjacent wash-lines. However, the intermediate holders do not constitute a continuous surface for supporting laundry but the task of said intermediate holders is to keep adjacent wash-lines at a predetermined distance from each other.

OBJECTS AND FEATURES OF THE INVENTION

A primary object of the present invention is to present a device of the type defined above that, in connection with drying, avoids the creation of folds from one or more wash-lines that supports the laundry.

A further object of the invention is that the possibility of drying the laundry not shall be affected negatively to any degree worth mentioning.

Still an object of the invention is that according to a certain embodiment of the invention the device does not require much space in an inactive position.

At least the primary object of the present invention is realised by means of a device that has been given the features of the appending independent claim. Preferred embodiments of the invention are defined in the dependent claims.

BRIEF DESCRIPTION OF THE DRAWINGS

Below embodiments of the invention will be described, reference being made to the accompanying drawings, where.

DETAILED DESCRIPTION OF PREFERRED EMBODIMENTS

Figure 1:
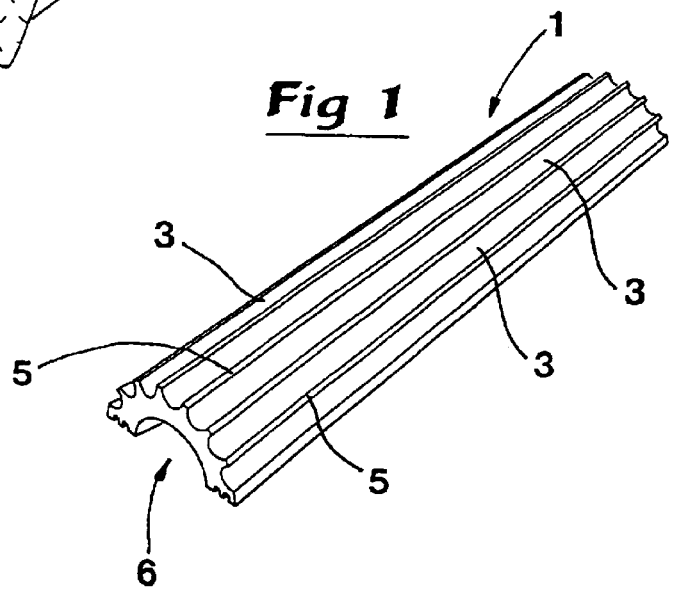
FIG. 1 shows a prospective view of a first embodiment of a device according to the present invention.
Figure 2:
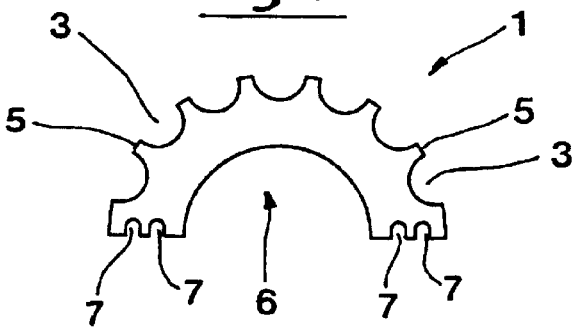
FIG. 2 shows an end view of the device according to FIG. 1.

In FIGS. 1 and 2 a first embodiment of the device 1 according to the present invention is shown. In cross section, see FIG. 2, said device 1 generally has the shape of a semi cylinder that externally defines an imaginary, convex surface and internally defines a concave surface. From FIG. 1 it is learnt that the device 1 according to the present invention has a certain extension in its longitudinal direction. On its outwardly facing surface the device 1 is equipped with a number of parallel first grooves 3 that extend in the longitudinal direction of the device. Between said first grooves 3 sub surfaces 5 in the shape of connecting portions are provided, said sub surfaces 5 also extending in the longitudinal direction of the device and being mutually parallel. Thus said sub surfaces 5 define the outwardly facing convex surface. In the shown embodiment seven first grooves 3 are provided on the external side of the device 1, said first grooves 3 having essentially semi circular cross-section. On its inner side the device 1 is equipped with a recess 6 that extends in the longitudinal direction of the device 1, said recess 6 preferably being smooth and having a semi circular cross section.

On its longitudinal end surfaces the device 1 is equipped with second, mutually parallel grooves 7. In the shown embodiment two second grooves 7 are provided in each longitudinal end surface, said end surfaces being located in a common plane. In the shown embodiment the second grooves 7 have a smaller depth and essentially less width than the first grooves 3.

Figure 3:
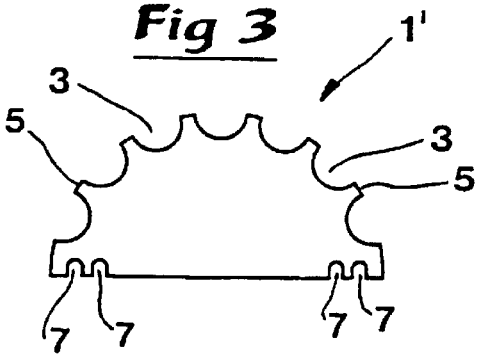
FIG. 3 shows an end view of a second embodiment of a device according to the present invention.

A second alternative embodiment of the device 1' according to the present invention is shown in end view in FIG. 3. In principle the device 1' differs from the device 1 in that the device 1' according to FIG. 3 has a solid cross section, i.e. said device 1' is not equipped with an internal recess.

As regards the design of the first grooves 3, the connecting portions 5 and the second grooves 7 are in principle the same in the device 1' according to FIG. 3 as in the device 1 according to FIGS. 1 and 2.

The fact that the device 1 generally has the shape of a semi cylinder makes it easier to pile compared to the device 1'. This is beneficial from space considerations, e.g. in shops or in connection with transport. Further the recess 6 of the device 1 according to FIGS. 1 and 2 brings about a smaller consumption of material than the device 1' according to FIG. 3.

Figure 4:
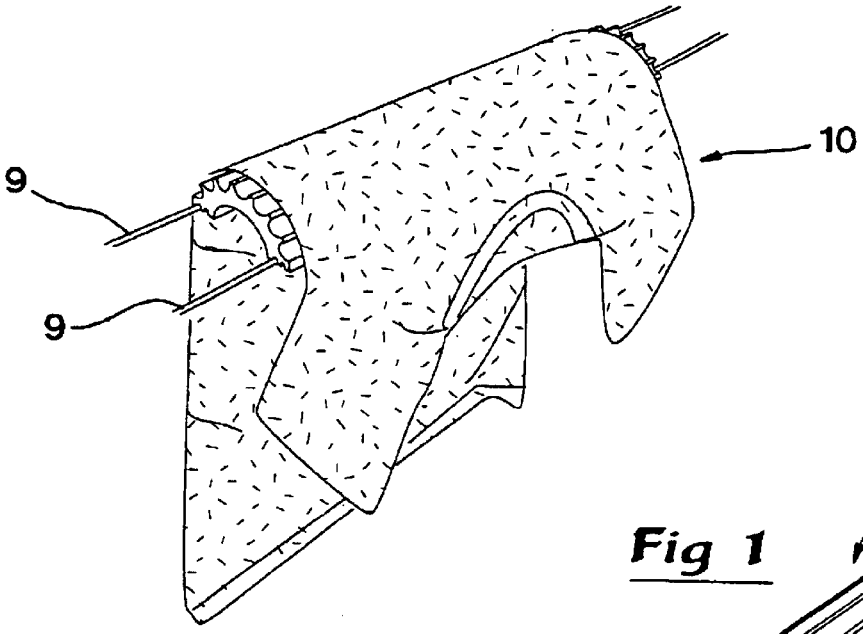
FIG. 4 shows a perspective view where the device according to FIG. 1 is in active position.

In FIG. 4 a preferred way of use of the device 1 is illustrated, said device having a certain length, i.e. the extension of the device 1 along two essentially parallel wash-lines 9 in FIG. 4, and a certain width, i.e. the extension of the device 1 in a direction transverse to said wash-lines 9. The length of the device 1 is essentially larger than its width.

The device 1 is mounted on said two essentially parallel wash-lines 9 that each, in connection with the mounting, is received in a second groove 7 of the device 1. Which groove 7 of the device 1 that is chosen depends on the mutual distance between the wash-lines 9. The mounting of the device 1 is extremely simple since said device 1 in principle only is laid on the wash-lines 9 that are fitted in the second grooves 7. When removing the device 1 according to the present invention from the wash-lines 9 one longitudinal edge of the device 1 is lifted and it is suitable that the adherent wash-line 9 is grasped and pulled out of the second groove 7. In a corresponding way the other longitudinal edge is removed.

When the device 1 according to the present invention is mounted on two adjacent parallel wash-lines according to FIG. 4 the device 1 is in principle ready for use and its external, convex surface, equipped with grooves, is facing upwardly. As is shown in FIG. 4 a garment 10, in the shown case a sweater, may be placed on the external, convex surface that is equipped with grooves, said sweater 10 abutting the connecting portions 5, see FIG. 2.

As is evident from FIG. 4 no folds are created on the sweater. 10 when it smoothly joins the external, convex surface of the device 1 according to the present invention.

The first grooves 3 of the device 1 makes it possible for air to circulate also on the side of the sweater 10 that faces towards the device 1.

The material in the device 1; 1' according to the embodiments shown in FIGS. 1–4 constitutes preferably a foamed plastic material. In exemplifying and non-restricting purpose reinforced cellular plastic or vacuum formed polyethylene may be mentioned. An aspect to be considered in connection with the choice of material is that the material should not be too slippery since in that case there is a risk that a hanging garment 10 slides off the device 1; 1'. The material of the device 1; 1' should be such that a certain friction is established between the garment 10 and the device 1; 1'.

As regards the dimensions of the device 1; 1' according to the present invention it may be mentioned in exemplifying and non-restricting purpose that the distance between the pair of grooves 7, i.e. in principle the distance between adjacent wash-lines 9, is of the magnitude 5–6 cm. The height of the device 1; 1' according to the invention, i.e. its extension above the plane that the wash-lines 9 are located in, is preferably 3–4 cm. The length of the device 1; 1' according to the present invention is preferably about 40 cm.

Figure 5:
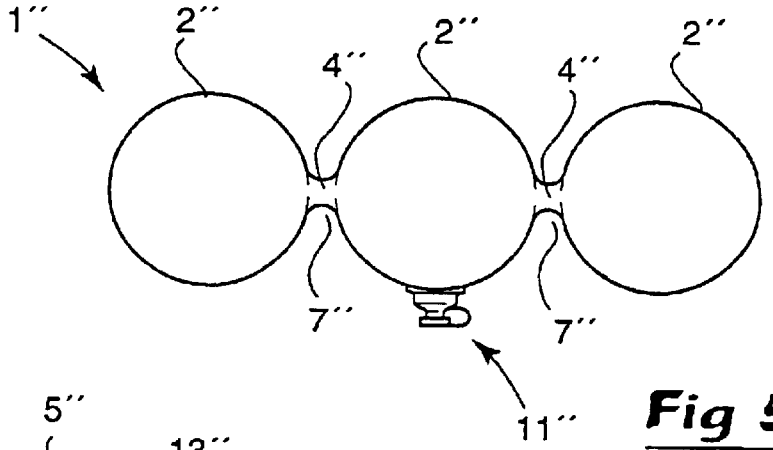
FIG. 5 shows a schematic end view of a third embodiment of the device according to the present invention.
Figure 6:
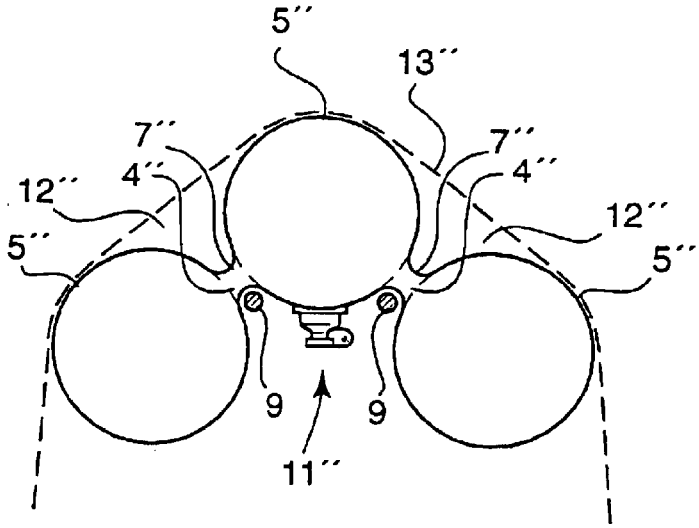
FIG. 6 shows a schematic end view of the device according to FIG. 5 in active position, i.e. mounted on two wash-lines.
Figure 7:
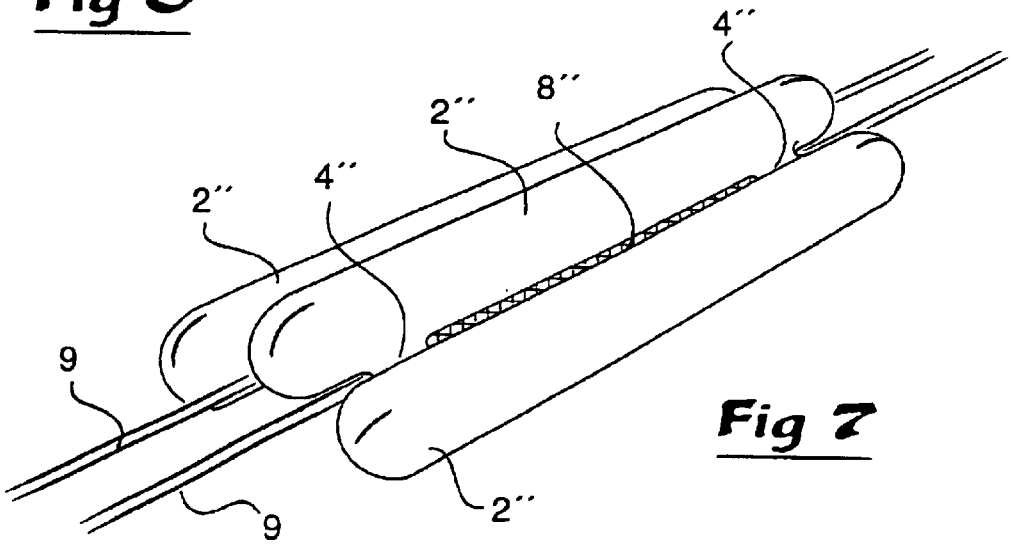
FIG. 7 shows a schematic perspective view of the device according to FIG. 5, mounted on two wash-lines.

A further alternative embodiment of the present invention is shown in FIGS. 5–7. Said embodiment constitutes in principle an inflatable device 1" in the shape of a casing, said device 1" being shown in FIG. 5 in unloaded but inflated condition. As is evident from FIG. 5 the device 1" comprises in principle three next to each other arranged, elongated sections 2" having generally circular cross section. In a simplified manner this may be expressed as three "sausages" being arranged next to each other. The sections 2" communicate mutually via a number of passages 4" that are evident in FIG. 7. Between the passages 4" the device 1", has portions 8" where opposite sides of the casing 1" are welded together or in another way connected to each other, said portions 8" being extremely elongate which is evident from FIG. 7. The portions 8" create folding notches 7" that is most evident from FIG. 6. In this connection it should be pointed out that the device 1" in no way is restricted to include exactly three sections 2", see below under the headline

Feasible Modifications of the Invention

The device 1" according to the present invention is also equipped with a valve 11" in order to supply air into the casing 1" or to discharge air from said casing 1". In a conventional way the valve 11" is equipped with means to seal it, i.e. to prevent air to be supplied or discharged from the device 1". It is immediately realised that the embodiment according to FIGS. 5–7 has the advantage that it requires extremely small space when it is empty of air.

When using the device/casing 1" according to FIGS. 5–7 the casing 1" is initially inflated in order to assume the basic shape shown in FIG. 5. In connection therewith air passes between the sections 2" via the passages 4" while air is not allowed to pass via the portions 8" that are welded together. When an appropriate amount of air has been supplied to the device 1" it is ready for use. Then the device 1" is placed on two essentially parallel wash-lines 9, see FIGS. 6 and 7, and the welded portions 8", together with the passages 4", serve as folding notches 7" for receiving said wash-lines 9, see FIG. 6.

It is evident from FIGS. 6 and 7 that the device 1" in its active position is hanging on two, essentially parallel, washed-lines 9, the upwardly/outwardly facing sub surfaces 5" of the sections/sausages 2" creating support surfaces for a garment or other flat, flexible object that is hung over the device 1". Thus said sub surfaces 5" define an imaginary curved surface that is convex on the side facing away from the device 1". A garment or other flat, flexible object is indicated by means of the reference numeral 13" in FIG. 6. In this connection it should be pointed out that between the garment 13" and the device 1" channels 12" or spaces are created, in which air may circulate. This arrangement is beneficial for the drying of the garment 13", i.e. the drying is effected more quickly.

Figure 8:
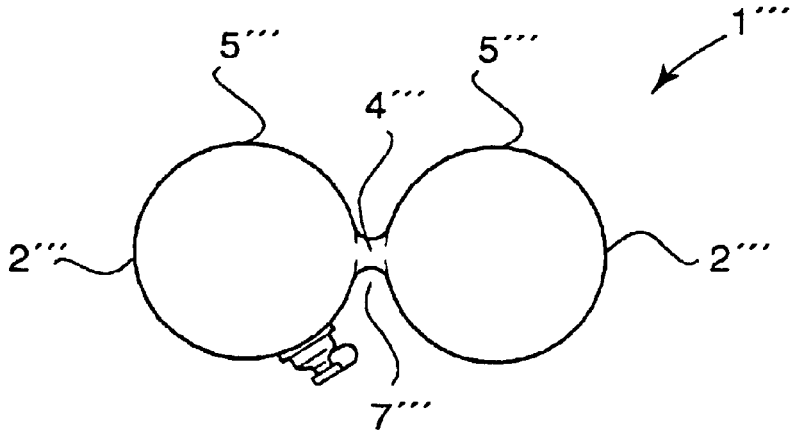
FIG. 8 shows a schematic end view of a fourth embodiment of the device according to the present invention.
Figure 9:
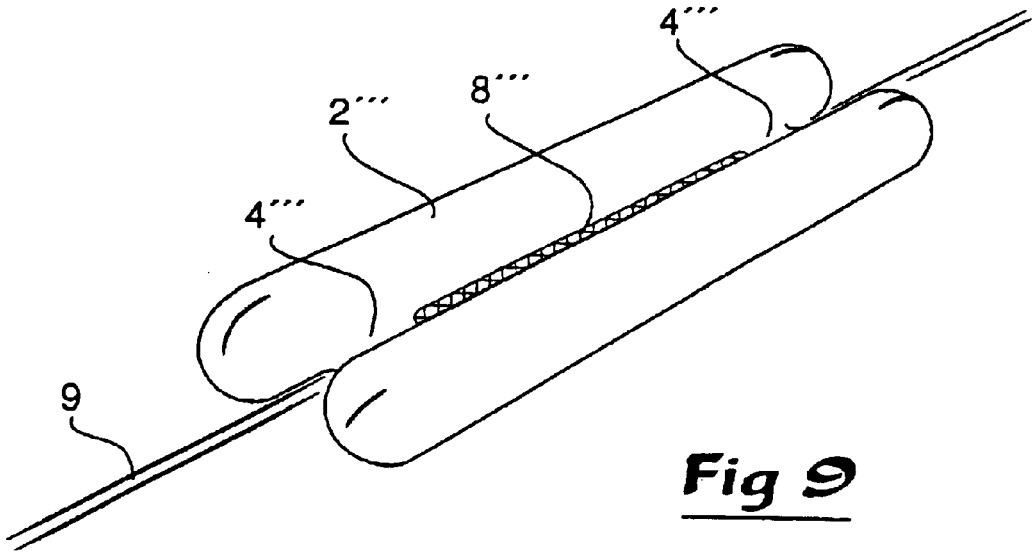
FIG. 9 shows a schematic perspective view of the device according to FIG. 8, mounted on one wash-line.

The fourth embodiment, shown in FIGS. 8 and 9, constitutes in principle, likewise the embodiment according to FIGS. 5–7, of an inflatable device 1'" in the shape of casing that is shown in un-loaded but inflated condition in FIG. 8. As is evident from FIG. 8 the device 1'" in principle comprises two next to each other provided elongated sections 2'" having generally circular cross-section. In a simplified manner this can be expressed as two "sausages" being arranged next to each other. The embodiment according to FIGS. 8–9 is structurally designed in a corresponding way as the embodiment according to FIGS. 5–7 apart from the fact that the embodiment according to FIGS. 8–9 comprises two sections/sausages 2'" while the embodiment according to FIGS. 5–7 comprises three sections/sausages 2".

It is evident from FIG. 9 that the device 1'" in its active position is hanging on one wash-line 9, the upwardly/outwardly facing sub surfaces 5'" of the sections/sausages 2'" creating support surfaces for a garment or other flat, flexible object that is hung over the device 1'". Otherwise the device 1'" functions in principle in the corresponding way as the device 1" according to FIGS. 5–7. In this connection it should however be pointed out that the wash-line 9 in this embodiment may be somewhat thicker than if two or more wash-lines are used.

Feasible Modifications of the Invention

The devices according to the embodiments according to FIGS. 1–7 are intended to be mounted on two adjacent, essentially parallel, wash-lines and the device according to the embodiment according to FIGS. 8–9 is intended to be mounted on a single wash-line. However, it is feasible that the device according to the present invention is designed in such a way that it is supported by three or more wash-lines that are essentially parallel to each other. This is most likely in connection with the embodiments according to FIG. 3 and FIGS. 5–7. As regards the embodiment according to FIG. 3 it may be suitable to provide a further intermediate groove 7. As regards the embodiment according to FIGS. 5–7 further sections 2" may be included, whereby wash-lines are received in the folding notches 7" between adjacent sections 2".

I claim:

1. A device to be used in connection with hanging laundry, said device for use in cooperation with at least one wash-line, and that said cooperation being that the wash-line supports the device, wherein the device has a length that is essentially larger than its width, and that the device has sub surfaces that define a curved surface that is convex on the side facing away from the device, a number of spaces are arranged between the sub surfaces, said spaces extending in the longitudinal direction of the device, the device constitutes a casing having at least two inflatable, elongated sections and that at least one folding notch is provided between said sections.

2. Device according to claim 1, wherein the sections communicate mutually via passages, through which air may pass.

3. Device according to claim 1, wherein portions are arranged between the sections, said portions having opposite sides of the casing connected to each other.

4. Device according to claim 3, wherein connecting portions are located between the passages, and that the connecting portions and the passages are located in the area of the folding notches.

* * * * *